US005365679A

United States Patent [19]

Chemello

[11] Patent Number: 5,365,679

[45] Date of Patent: Nov. 22, 1994

[54] SKI BOOT INCORPORATING WATERTIGHT CLOSURE

[75] Inventor: Jean-Pierre Chemello, Annecy-Le-Vieux, France

[73] Assignee: Salomon S.A., Chavanod, France

[21] Appl. No.: 71,500

[22] Filed: Jun. 4, 1993

[30] Foreign Application Priority Data

Jun. 4, 1992 [FR] France ..... 92 07011

[51] Int. Cl.[5] ..... A43B 5/04

[52] U.S. Cl. ..... 36/117; 36/50.5

[58] Field of Search ..... 36/117–121, 36/50.5, 54, 4, 50.1; 24/68 SK, 70 SK, 71 SK, 69 SK

[56] References Cited

U.S. PATENT DOCUMENTS

| | | | |
|---|---|---|---|
| 139,234 | 5/1873 | Buck | 36/50.1 X |
| 197,699 | 11/1877 | Walker | 36/50.1 X |
| 347,653 | 8/1886 | Sloan | 36/50.1 |
| 868,484 | 10/1907 | Richardson | 36/4 |
| 899,978 | 9/1908 | Hessler | 36/50.1 |
| 1,124,868 | 1/1915 | Dassori | 36/54 |
| 1,686,399 | 10/1928 | Rohrbacker, Jr. | 36/50.1 |
| 2,494,964 | 1/1950 | Rome | 36/117 |
| 2,591,211 | 4/1952 | Spencer | 36/54 X |
| 3,657,757 | 4/1972 | Vilder | 36/4 X |
| 4,115,905 | 9/1978 | Seidel | 36/50.5 X |
| 4,387,517 | 6/1983 | Annovi | 36/50.5 X |
| 4,841,650 | 6/1989 | Dodge et al. | 36/119 |
| 5,228,219 | 7/1993 | Tonel | 36/117 |

FOREIGN PATENT DOCUMENTS

| | | | |
|---|---|---|---|
| 990624 | 9/1951 | France . | |
| 0187465 | 10/1956 | Germany | 36/50.1 |
| 1904847 | 7/1970 | Germany . | |
| 1808115 | 8/1970 | Germany . | |

*Primary Examiner*—Paul T. Sewell
*Assistant Examiner*—Ted Kavanaugh
*Attorney, Agent, or Firm*—Pollock, Vande Sande & Priddy

[57] ABSTRACT

Ski boot in which at least one opening/closing area (7) designed to allow insertion of the foot when the boot is put on/taken off comprises at least two flaps (9, 10) which join by overlapping and in which the movement by which the flaps are drawn together one over the other is controlled by at least one tightening device (12) which connects them in the boot closure position. The boot is provided with a flexible watertight covering element (8, 28) mounted on the outside of its shell on the opening/closing area (7) and encloses the two flaps (9, 10) by sealing the gap (18) remaining between them in the closed position.

8 Claims, 3 Drawing Sheets

SKI BOOT INCORPORATING WATERTIGHT CLOSURE

FIELD OF THE INVENTION

The present invention relates to boots whose instep is closed by the application of pressure effected using a tightening device comprising at least one exterior flap overlapping at least one interior flap so as to bring these flaps mutually closer together and thus modify the volume of the boot in order to tighten it over the foot; it concerns, in particular, a means for providing for water-tightness of a closure of this kind.

BACKGROUND OF THE INVENTION

The great majority of conventional boots incorporating a closure of this kind include boots whose shell is rigid or semi-rigid, e.g., "traditional entry" ski boots.

One conventional type of "traditional entry" ski boot, such as that described in FR 2 022 964, has a structure in which a shell base designed to receive the foot is surmounted by an upper intended to encase the lower leg. As disclosed, the shell base comprises an opening in the area corresponding to the instep/flection fold, and a tongue which seals this opening and originates at the tip of the boot. This tongue extends into the flection fold area and is advantageously connected to the edges of the opening using flexible segments which form a watertight bellows. This construction is a definite improvement as compared with "free" tongues, i.e., those which are merely attached or originate at the tip of the boot. In fact, because of the geometry of conventional tongues, which separates them distinctly from the front part of the upper (shell base), they cannot really provide water-tightness of the boot. Accordingly, it is desirable for the edges of the tongues to be attached to the edges of the opening in the shell base, as in the example represented by FR 2 022 964. It will be noted that the use of this means of providing water-tightness, which is molded in a single piece with the boot upper, proves relatively easy to incorporate into this type of construction, since there is really no edge-to-edge superposition of the tongue in conjunction with the edges of the upper placed opposite each other. Furthermore, as acted upon by the lace-tightening device, the tongue is pressed down principally on the top of the foot while also pushing the water-tightness element back against the latter. It is the tightening device which tends to draw the edges of the opening closer together. Pressure exerted on the tongue thus does not cause these edges to move closer together.

Another type of "traditional entry" ski boot, described in Patent No. DE 1 904 847, comprises a shell base designed to house the foot, this shell base being equipped with a walking sole and surmounted by an upper designed to encase the lower leg. As taught and illustrated, the shell base at least is open at the top in the area corresponding to the instep/flection fold. This opening extends along the longitudinal axis of the boot and exists as a slot delimited by the overlapping of an exterior transverse flap originating on one of the sides of the shell base over an interior transverse flap originating on the opposite side of the shell base. Depending on the structure of the tightening device used to apply pressure to the exterior flap positioned over the interior flap, these flaps are sized so as to cover the instep area and up to the area of the front part of the foot adjoining the toes, i.e., the tip of the boot. Seen laterally, the entry to this slot is given material form by the position of the free end edge of the exterior flap in relation to the wall opposite the interior flap, and it thus extends, lengthwise, at a distance relatively close to the median longitudinal axis of the boot, and, widthwise, on the front portions of the flaps, which are superposed transversely to this longitudinal axis while projecting at least partially from the top of the boot tip by their respective narrow edges. The water-tightness of the closure for this type of ski boot is obtained laterally by pressing the exterior tongue on the interior tongue and, according to the improvement introduced by the invention, by the addition of a bellows-type jointing element positioned on the front part of the slot in proximity to the tip of the boot and in conjunction with the transverse ends of the projecting flaps. This jointing element, or bellows, is arranged inside the shell base and is connected in an edge-to-edge configuration to the edges of the flaps, solely in the area of the boot tip. As designed, when closure is effected, the bellows folds back on itself, and any movement bringing the exterior and interior flaps closer together from that closure position tends to stretch the bellows. It will also be noted that, since the bellows is positioned inside the shell base, the opening of the boot by drawing the flaps apart (putting on or taking off the boot) exposes the bellows and thus makes possible, during this operation, the penetration of snow, gravel, etc. between the bellows and the flaps to which it is attached.

SUMMARY OF THE INVENTION

It is an object of the present invention to achieve water-tightness from the outside of the closure of a "conventional entry" ski boot comprising transverse flaps which join by overlapping and which are subjected to the action of at least one tightening device.

Another object of the invention is to achieve complete water-tightness through the use of a system which does not hinder the opening and closing of "conventional entry" boots and which extends continuously from one side to the other of the boot opening/closing area.

The invention concerns a ski boot whose shell base is provided with a sole and an upper and comprises at least one opening/closing area which extends substantially in the longitudinal axis of the boot and is constituted by at least two relatively flexible flaps which join by overlapping, one extending toward the inside of the boot while the other remains on the outside of thereof and above the first flap. The flaps preferably extend transversely to the longitudinal axis of the boot and are brought together and positioned over one another by means of a conventional tightening device such as a tension device/buckle, tension device/cable, and the like which; connects them in the boot closure position.

According to the invention, water-tightness is achieved by the use of a flexible watertight covering element mounted on the outside of the boot in the opening/closing area comprising the flaps, which it partially encloses while sealing the gap remaining between them in the boot closure position. The covering water-tightness element preferably forms a fold extending inside the boot in the gap formed by the overlapping flaps, thereby giving it a continuous profile substantially zigzag in shape. The water-tightness element is integrally attached to the outside of the boot by any conventional assembly means, e.g., adhesive bonding, welding, tacking, etc., or by simply using the attachment elements belonging to the tightening device, which connects the flaps in the boot closure position. To that end, the water-tightness element may advantageously be arranged in a "sandwich" configuration between the base of a hook and the base of a rack with which this hook, associated with a buckle, cooperates.

According to one embodiment of the invention, the flexible water-tightness element is inextensible and, in this case, the fold it forms inside the boot has an extended length which at least matches the minimum distance separating the flaps when the latter are drawn apart to form the boot opening. To promote return to the initial position of the fold of the water-tightness element between the two flaps and inside the boot, this element is advantageously fastened, for example by gluing, to the end of the free edge of the exterior flap and in proximity to the free edge of the interior flap, so that, in the natural release position of these flaps, the point of connection located at the end of the free edge of the exterior flap always extends beyond the connection area located on the interior flap. As a result of this configuration, the portion of flexible material of the water-tightness element extending between the two connections is stressed so as to take on an undulation which is more pronounced in proximity to the interior connection, and thus to remain beneath the outer flap.

According to another embodiment of the invention, the flexible water-tightness element is extensible. In this case, it may have a mounting configuration that is either comparable to the just described embodiment, or one in which the water-tightness element is a film or membrane without functional fold and designed to allow the flaps to be drawn apart, this gap being produced simply by manipulating the extensibility of the film and/or membrane, i.e., its elastic elongation properties, in order to open the boot. The membrane then extends inside the exterior flap, on the outside of the interior flap, and it seals the gap resulting from the overlapping of the flaps. It is obvious that, in this embodiment, the water-tightness element is then connected basically to the outside of the boot and on the interior flap, at a distance from the free end of the exterior flap sufficient to permit relative sliding motion of the flaps when they are brought together to the maximum extent by means of the tightening device connecting them in the boot closure position.

BRIEF DESCRIPTION OF THE DRAWINGS

The invention will be better understood by referring to the following description and to the attached schematic drawings illustrating two embodiments of the invention and in which.

DESCRIPTION OF THE PREFERRED EMBODIMENT

Figure 1:
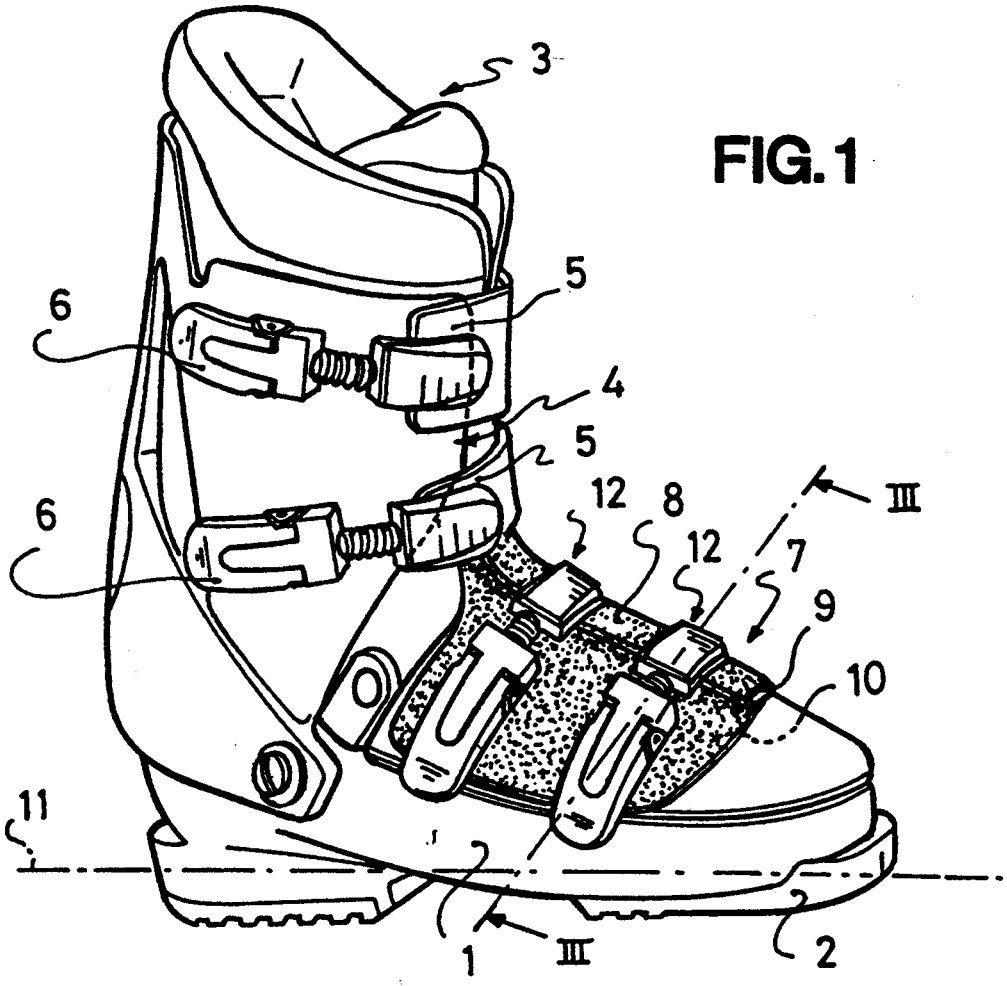
FIG. 1 is a perspective view of a "conventional entry" alpine ski boot provided with a water-tightness element according to the invention mounted on the shell base.
Figure 2:
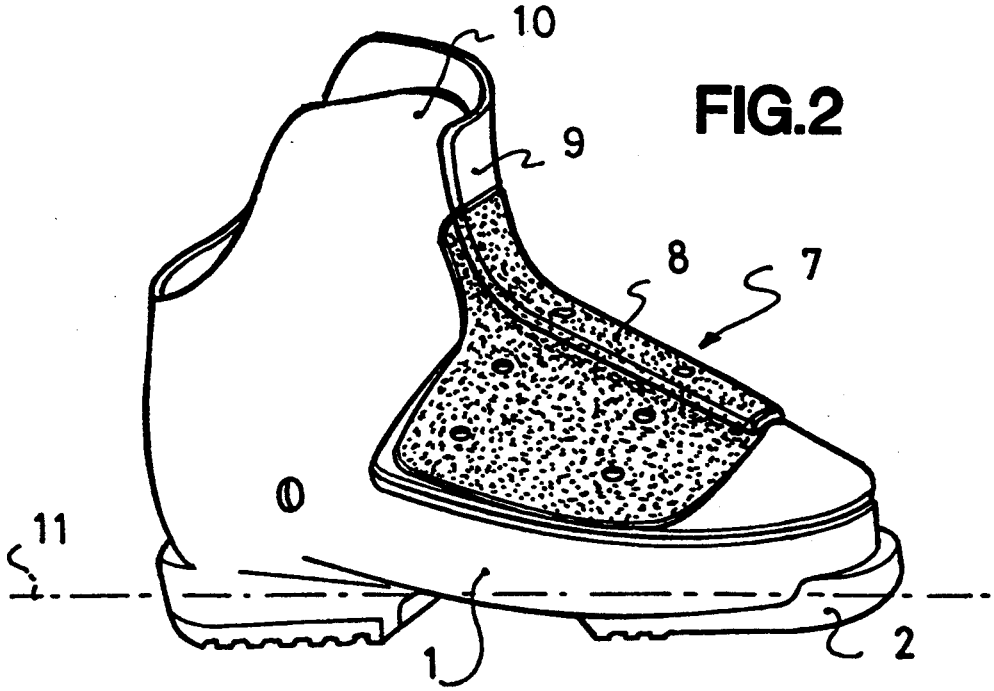
FIG. 2 is a perspective view of the shell base of the boot illustrated in FIG. 1.
Figure 3:
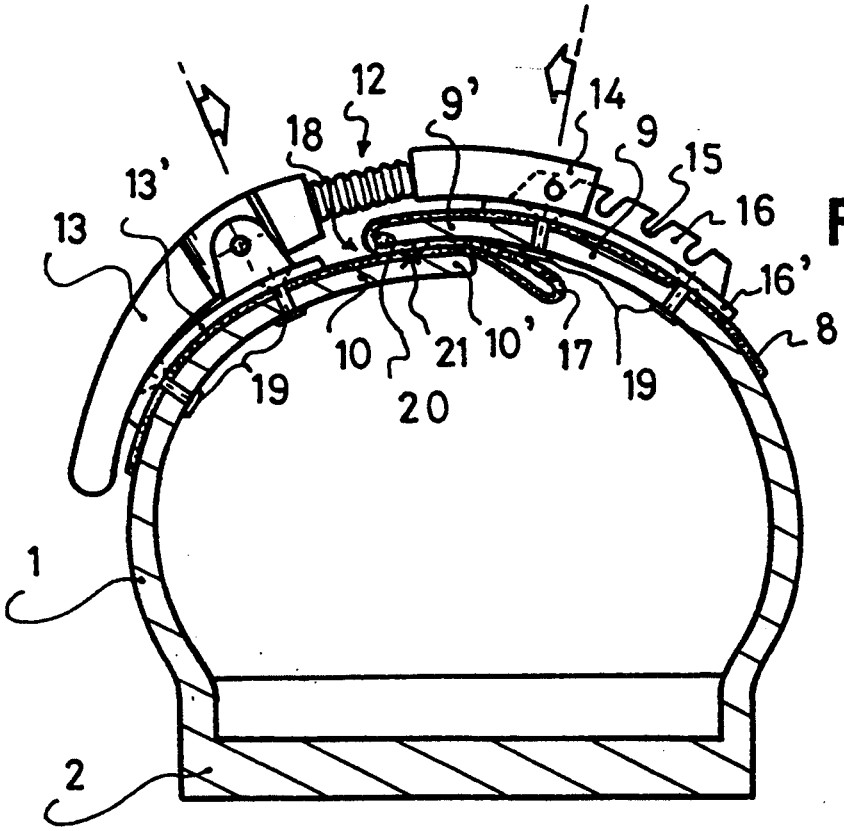
FIGS. 3 and 4 are transverse cross-sections along line III—III of the boot in FIG. 1, illustrating respectively the closure of the shell base and a "natural" release position corresponding to the opening of the shell base.
Figure 4:
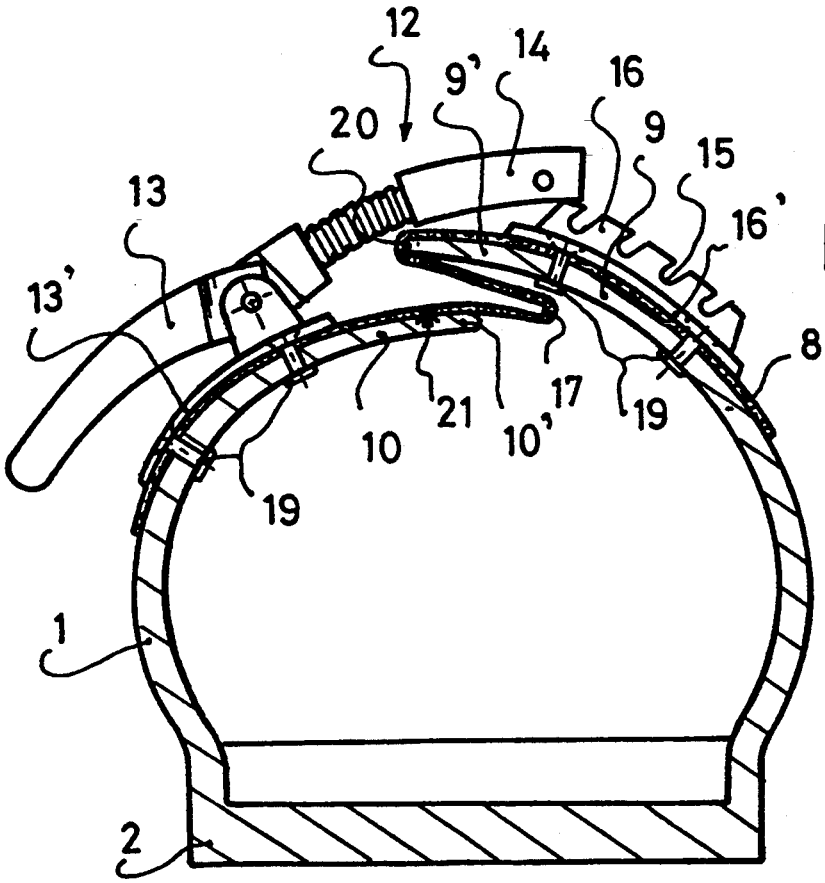

The ski boot illustrated in FIG. 1 is a conventional entry boot, i.e., it opens on its upper front portion, substantially in its longitudinal axis. This boot has a shell base 1 fitted with a sole 2 and a collar-shaped upper 3. In this embodiment of the boot, the opening/closing area 4 of the upper 3 is closed conventionally using two transverse tongues 5 attached to tension devices 6, while only the opening/closing area 7 of the shell base 1 (FIGS. 1 and 2) is equipped with a water-tightness element 8 according to the invention. This water-tightness element 8 is proportioned to the flexible flaps 9 and 10, which join by overlapping, the flap 10 extending toward the inside of the boot beneath the flap 9, which remains on the outside. As illustrated, the flaps 9 and 10 external transversely to the longitudinal axis 11 of the boot and are controlled by at least one tightening device 12 by which they are drawn together and superposed on each other, as shown in FIGS. 3 and 4. This tightening device 12 is, in this embodiment, constituted by a tension lever device 13 fitted with a fastening device 14, such as a hook, designed to cooperate with at least one of a series of notches 15 provided in a rack 16, in order to connect the flaps 9 and 10 in the boot closure position.

According to the invention, the water-tightness element 8 made of a flexible, waterproof material, is mounted on the outside of the boot and adheres substantially to the contour of the profile of the free edge 9' of the exterior flap 9, extends back toward the inside of the boot while forming a fold 17, and is then extended on the outer surface of the interior flap 10 approximately up to the site of the tension lever device 13. The gap 18 formed by the overlapping of the flaps 9 and 10 in the closed position (FIG. 3) is thus sealed by the water-tightness element 8, which then has a substantially zigzag profile. It is evident that the water-tightness element 8 can be integrally attached to the outside of the boot using and known assembly means, i.e., adhesive bonding, but can advantageously be attached using rivets 19 which fasten the base 13' of the tension lever device 13 and the base 16' of the rack 16. The water-tightness element 8 is then preferably mounted in a sandwich configuration between these bases 13' and 16' and the outer surface of the flaps 9 and 10 originating in the shell base 1.

According to a first embodiment of the invention, the water-tightness element 8 is inextensible. In this case, the fold 17 which it forms inside the boot has an extended length which at least matches the length of the minimum distance separating the flaps 9 and 10 to be reached in order to open the boot, i.e., to permit the insertion and withdrawal of the foot from the boot.

Figure 6:
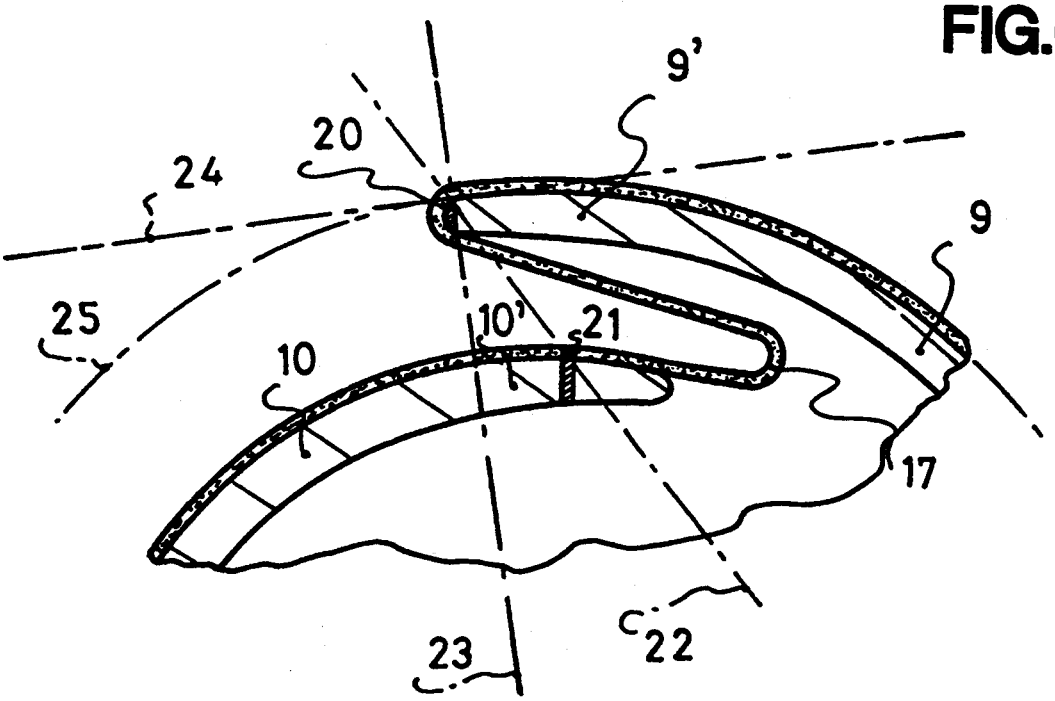
FIG. 6 is a view of a detail in FIG. 4, showing a method of fastening the water-tightness element to the flaps belonging to the shell base.

To ensure the maintenance of the fold 17 inside the boot, the water-tightness element 8 is advantageously attached to the end 20 of the free edge 9' of the exterior flap 9 and at least in proximity 21 to the free edge 10' of the interior flap 10, so that, in the natural release position of these flaps, as illustrated in FIG. 4, the end 20 or upper connection of the exterior flap 9 always extends beyond the area 21 in which the water-tightness element 8 is connected to the interior flap 10. According to this configuration, shown in greater detail in FIG. 6, the connections 20 and 21 lie in a plane 22 which extends, beginning at the connection 20, diagonally in relation to the line 23 perpendicular to the tangent 24 of the arc 25 in which the shape of the exterior flap 9 is at least partially inscribed. As a result of this assembly, the fold 17 of the water-tightness element 8 tends to remain folded continuously on the side toward which it initially extends when assembled and/or deployed, in particular toward the inside of the boot in the present instance; moreover, it remains positioned beneath the exterior flap 9 when the boot is opened. It is obvious that the arrangements just described for the use of an inextensible water-tightness element 8 are also applicable and practicable for an extensible water-tightness element. On the other hand, when the water-tightness element is extensible, other assembly arrangements can be implemented.

Figure 5:
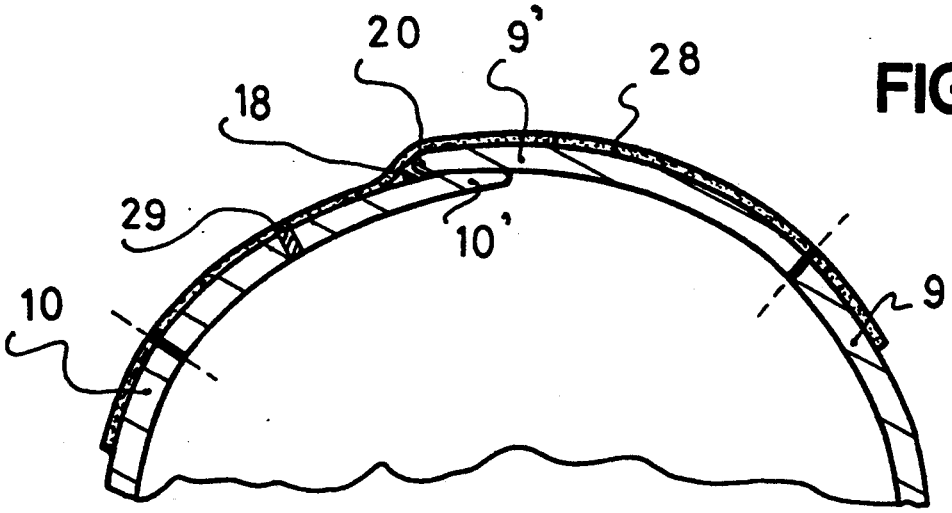
FIG. 5 is a schematic cross-section, again along line III—III, of the boot in FIG. 1, illustrating another embodiment of the water-tightness element according to the invention.

Accordingly, as in the example illustrated in FIG. 5, the extensible water-tightness element 28, which is made of a film or membrane without functional fold 17 designed to allow the flaps 9 and 10 to be drawn apart, is placed simply so as to cover the gap 18 formed by the overlap of these flaps. In this assembly configuration, the boot is opened, and thus, the flaps 9 and 10 are drawn apart simply by utilizing the elasticity belonging to the water-tightness element 8. It is evident that the water-tightness element 8 is connected basically to the outside of the boot, and, in particular, to the interior flap 10 at a point 29 located at a distance sufficient from the end 9' of the exterior flap 9 to permit the flaps 9 and 10 to slide to move closer together when the tightening device 12 (not illustrated in detail) connects them in the boot closure position.

The invention also encompasses opening/closing areas of a boot other than that of a shell base 1, as described with reference to FIGS. 1 to 4. The invention can, in particular, relate to the upper 3 of a boot, whether to the front 4 or rear area of the latter.

What is claimed is:

1. Ski boot in which at least one opening/closing area (7) designed to allow insertion of a foot when the boot is put on/taken off comprises interior and exterior flaps (9, 10) which join by overlapping and in which a movement by which said flaps are drawn together over one another is controlled by at least one tightening device (12) which connects said flaps when said boot is in a closed position, wherein a flexible watertight covering element (8, 28) is mounted on the outside of the boot and encloses said two flaps (9, 10) by sealing a gap (18) remaining between them in said closed position, said covering element (8, 28) forming a fold (17) extending inside said boot in said gap (18) formed by the overlapping of said flaps (9, 10) which gives said covering element a zigzag profile.

2. Ski boot according to claim 1, wherein an extended length of the fold (17) formed by said covering element (8, 28) inside said boot corresponds to a maximum distance separating said flaps (9, 10) when said boot is in an open position.

3. Ski boot according to claim 1, wherein said water-tightness element (8, 28) is connected to an end (20) of a free edge (9') of said exterior flap (9) and in proximity (21) to a free edge (10') of said interior flap (10), the connection to said end (20) of said free edge (9') of said exterior flap extending beyond an area of connection (21) located on said interior flap (10) in the open position of said flaps (9, 10).

4. Ski boot according to claim 1, wherein said water-tightness element (28) is extensible.

5. Ski boot according to claim 1, wherein said water-tightness element (28) is constituted by an extensible membrane extending from an outside of said exterior flap (9) to an outside of said interior flap (10) and sealing said gap (18) formed by the overlap of said flaps (9, 10).

6. Ski boot according to claim 5, wherein said extensible water-tightness element (28) has elastic elongation properties allowing said flaps (9, 10) to be drawn apart until said open position is reached.

7. Ski boot according to claim 1, wherein said water-tightness element (8, 28) is integrally attached to an outside of the boot by means of elements (19) used to fasten said tightening device (12) ensuring the connection of said flaps (9, 10) in said closed position.

8. Ski boot according to claim 1, wherein said water-tightness element (8, 28) is integrally attached to an outside of the boot by assembly in a sandwich configuration between bases (13', 16') of a tension lever device (13) and of a rack (16) belonging to said tightening device (12), said bases (13' and 16') being arranged on said interior and exterior flaps (10, 9) respectively.

* * * * *